US007361262B2

(12) United States Patent
Dahms et al.

(10) Patent No.: US 7,361,262 B2
(45) Date of Patent: Apr. 22, 2008

(54) ACID PLATING BATH AND METHOD FOR THE ELECTROLYTIC DEPOSITION OF SATIN NICKEL DEPOSITS

(75) Inventors: Wolfgang Dahms, Berlin (DE); Klaus-Dieter Schulz, Berlin (DE); Thomas Moritz, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 10/515,412

(22) PCT Filed: May 15, 2003

(86) PCT No.: PCT/EP03/05134

§ 371 (c)(1),
(2), (4) Date: Dec. 22, 2004

(87) PCT Pub. No.: WO03/100137

PCT Pub. Date: Dec. 4, 2003

(65) Prior Publication Data

US 2005/0150774 A1 Jul. 14, 2005

(30) Foreign Application Priority Data

May 23, 2002 (DE) ..... 102 22 962

(51) Int. Cl.
*C25D 3/12* (2006.01)
*C23C 18/00* (2006.01)

(52) U.S. Cl. ..... 205/276; 205/271; 106/1.27

(58) Field of Classification Search ..... 106/1.27; 205/271, 276
See application file for complete search history.

(56) References Cited

U.S. PATENT DOCUMENTS 3,839,165 A * 10/1974 Strauss et al. ..... 205/276
4,058,439 A * 11/1977 Tamura et al. ..... 205/279
5,897,763 A * 4/1999 Elligsen et al. ..... 205/271
6,306,275 B1 * 10/2001 Donovan et al. ..... 205/99
6,306,466 B1 10/2001 Feldstein

FOREIGN PATENT DOCUMENTS

| | | | |
|---|---|---|---|
| DE | 1 621 087 | | 8/1967 |
| DE | 1 621 085 | | 5/1971 |
| DE | 2134457 | C2 | 7/1971 |
| DE | 23 27 881 | | 6/1973 |
| DE | 25 22 130 | | 5/1975 |
| DE | 2522130 | B1 * | 10/1976 |
| DE | 37 36171 | A1 | 10/1987 |
| DE | 195 40011 | A1 | 10/1995 |
| DE | 100 25 552 | C1 | 5/2000 |
| EP | 0 087 697 | A1 | 11/1997 |
| EP | 1020542 | | 7/2000 |
| JP | 56152988 | | 11/1981 |
| WO | WO 0188227 | A1 * | 11/2001 |

* cited by examiner

*Primary Examiner*—Edna Wong
(74) *Attorney, Agent, or Firm*—Paul & Paul

(57) ABSTRACT

The plating bath for the deposition of satin nickel deposits according to the present invention contains at least one quarternary ammonium compound and at least one polyether, the at least one polyether having at least one strongly hydrophobic side chain. As compared to prior art plating baths, this acid plating bath has the advantage that it enables a long period of operation or heating and cooling cycles or filtration cycles, makes it possible to perform the filtration needed for continually operating the bath without using active carbon, requires a lower concentration of nickel than prior art baths to produce the satin gloss finish and has a reduced sensitivity to wetting agents that have been dragged in.

14 Claims, No Drawings

ACID PLATING BATH AND METHOD FOR THE ELECTROLYTIC DEPOSITION OF SATIN NICKEL DEPOSITS

CROSS-REFERENCE TO RELATED APPLICATIONS

This application is the U.S. National Stage under 35 U.S.C. 371 of International Application PCT/EP03/05134 filed on May 15, 2003 which claims priority to German patent application DE 102 22 962.7 filed on May 23, 2002.

This application is the U.S. National Stage under 35 U.S.C. 371 of International Application PCT/EP03/05134 filed on May 15, 2003 which claims priority to German patent application DE 102 22 962.7 filed on May 23, 2002.

BACKGROUND OF THE INVENTION

The invention relates to an acid plating bath and to a method for the electrolytic deposition of satin nickel deposits. Electrolytes for obtaining matte nickel deposits, by contrast, do not form part of this invention.

In nickel electroplating, one generally tries to achieve a bright, level deposit. It has also soon been found out that silk matte deposits have an aesthetic appearance while preventing disturbing blinding effects. Combined with semi-bright nickel and with a chromium layer, such type layers provide the same protection from corrosion as a bright nickel layer. These satin nickel layers are widely used in the automotive industry, in precision mechanics, in the sanitary industry and eventually even in the furniture industry.

Hereto before, the satin effect could be produced using various methods. At first, the satin effect was obtained using mechanical methods with the bottom layer being matted by sandblasting. Later, insoluble substances of a certain fineness such as glass, French chalk, barium sulfate, graphite, kaolin or similar substances were added to the nickel electrolyte. Whereas the first method involved a considerable expense and did not fit in the electroplating process, the satin effect obtained using the insoluble substances was rougher than silk matte and had an irregular surface.

Organic substances that are difficult to dissolve, comprising in part stabilizing wetting agents did not show any lasting success:

DE-OS 1 621 085 discloses an acid nickel plating bath to provide satin nickel deposits that, in addition to primary brighteners, contains a concentration of such type substituted or unsubstituted adducts of ethylene oxide or propylene oxide or ethylene oxide/propylene oxide which, at a temperature of 40-75° C., form a fine emulsion in the electrolyte bath with said concentration ranging from 5 to 100 mg/l.

Further, DE 25 22 130 B1 describes an acid, aqueous nickel plating bath, nickel/cobalt plating bath or nickel/iron plating bath for depositing silk matte layers that contains, in addition to the primary and/or secondary brighteners, emulsified liquid polysiloxane polyoxyalkylene block copolymers.

Moreover, in Patent Abstract of Japan, the document JP 56152988A discloses a nickel bath for depositing satin coatings that contains, in addition to saccharine as a brightener and to polyoxyethylene-polyoxypropylene block copolymers, wetting agents selected from the group of the alkylaryl sulfonates and of esters of sulfosuccinic acid. In this case as well it was established that a satin nickel layer can only be obtained for a short period of time after the bath has been prepared. After that, the coatings obtained are rough and unsightly.

DE 21 34 457 C2 furthermore discloses an aqueous electroplating bath for depositing bright nickel or nickel/cobalt layers. According to some examples, an ester of sulfosuccinic acid is, among others, added to baths already containing saccharine as a secondary auxiliary brightener. These baths are not used to produce satin layers.

A method that has gained much more acceptance makes use of adducts of polyalkylene oxide, mostly adducts of ethylene oxide/propylene oxide, with water or aliphatic alcohols, that dissolve completely in the cold nickel electrolyte but are insoluble at an operating temperature of 50-60° C. (DE-OS 1 621 087). It is known that, upon exceeding the cloud point temperature, the non ionogenic surface active agents precipitate by getting rid of their hydrate shell. These precipitating drops selectively disturb the deposition of nickel without being substantially incorporated into the nickel. The disadvantage of this method is the high expense of energy for heating and cooling as well as for pumping. The maximum volume of the bath is also restricted since, as it reaches about 8,000 liter, the expense for heating, cooling and pumping increases dramatically. Moreover, agglomerates, which produce black pits, often form after a short period of time.

In view of the shortcomings described, a method is gaining increasing acceptance in which quaternary ammonium compounds are utilized in the bath. DE 23 27 881 A1 describes a method of producing matte nickel deposits or nickel/cobalt deposits by which the matt deposits are obtained by incorporating foreign substances. The foreign substances are achieved by combining cationic active or amphoteric substances with organic anions. Possible cationic active or amphoteric substances are quaternary ammonium compounds, imidazoline derivatives, esters of alkanolamines and surfactants based on amino carboxylic acid. Together with the anionic primary brighteners contained in the nickel electrolyte, the cationic active substances form ion pairs that are difficult to dissolve and that produce a satin effect by disturbing the nickel deposition process. Unfortunately, this method also has disadvantages:

Within approximately 3-5 hours the precipitating, difficult to dissolve ion pair crystallites increase in size and produce an increasingly coarse nickel surface or even clearly visible coarse single nickel crystals ("diamonds") that are very detrimental to the appearance of the nickel surface. Therefore, the production must be disrupted after 8 hours at the latest to completely filter and clean the electrolyte using filtering means such as a cellulose filter, kieselguhr or even activated carbon. This disruption in production is very disturbing and very costly, more specifically if an automatic machine is being used. Moreover, a film that may be wiped off often forms after chromium plating for 10 minutes and longer ("silver layer").

Some attempts have been made to overcome this shortcoming. One solution consisted for example in combining the two methods and in adding organic, aromatic sulfinic acids to the bath intended to produce satin nickel deposits. Such a bath composition is described in DE 37 36 171 A1. In this case, no optically uniform deposits are obtained without cooling and heating.

The use of a concentration of highly effective non ionogenic wetting agents (polyethylene glycol monomethyl ether) so small that the bath lacks any visible cloudiness is not successful either. DE 195 40 011 A1 indicates another method for the electrolytic deposition of nickel deposits with no blinding effect that makes use of a nickel bath containing inter alia primary brighteners, organic sulfinic acids and wetting agents. The bath further contains a concentration of substituted and/or unsubstituted adducts of ethylene oxide or of propylene oxide or of ethylene oxide/propylene oxide so small that the bath lacks any visible cloudiness at the operating temperature of the bath. The use of the indicated concentration of non ionogenic wetting agents is not successful because their efficiency decreases very soon and the appearance of the deposit quickly changes.

All of the methods described can only be operated for a few hours. An improvement was achieved by using esters of sulfosuccinic acid together with ammonium compounds (DE 100 25 552 C1). The high amount of nickel ions in excess of 105 g/l required and the sensitivity to foreign wetting agents (that have been dragged in) are disadvantageous, though. Furthermore, the bath, which needs cleaning, can only be successfully cleaned with active carbon, which is quite inconvenient to handle since the filter can only be used once and the filter residue has to be disposed of after each cleaning. On the other side, problems arise during chromium plating because of the formation of a film that may be wiped away ("silver layer").

SUMMARY OF THE INVENTION

It is therefore the object of the present invention to provide a bath and a method for electrolytic deposition of nickel with a satin gloss finish that do not give rise to the afore mentioned problems and that more specifically enable a long period of operation or heating and cooling or filtration cycles, make it possible to perform the filtration needed for continually operating the bath without using active carbon, require a lower concentration of nickel than prior art baths to produce the satin gloss finish and have a reduced sensitivity of the bath to wetting agents that have been dragged in.

The solution to this problem is achieved by the acid plating bath for the electrolytic deposition of satin nickel deposits and by the method for the electrolytic deposition of a satin nickel deposit described herein.

Before the present invention of acid plating nickel deposits with a satin gloss finish is disclosed and described, it is to be understood that this invention is not limited to the particular process steps and materials disclosed herein as such process steps and materials may vary somewhat. It is also to be understood that the terminology used herein is used for the purpose of describing particular embodiments only and is not intended to be limiting since the scope of the present invention will be limited only by the appended claims.

DETAILED DESCRIPTION OF THE INVENTION

It has been found that a stable satin effect is obtained during nickel deposition if at least one polyether, each having at least one strongly hydrophobic side chain, is added to the electrolyte intended to produce satin nickel deposits and containing at least one quaternary ammonium compound that acts as a cationic active wetting agent. For this purpose, a substrate to be coated is brought into contact with the inventive electrolyte plating bath and a flow of electric current is set between the substrate and one anode.

The nickel electrolyte preferably contains at least one anionic primary brightener and may contain a concentration of nickel of already less than 100 g/liter, for example of at least 70 g/liter.

In the case in accordance with the invention, the efficiency of the polyethers with strongly hydrophobic side chains corresponds to that of a typical wetting agent, the strongly hydrophobic side chain selectively interfering with the deposition of nickel from the bath so that the nickel deposited has a satin gloss finish. The compounds of the invention are soluble in the electrolyte so that a clear solution can be formed. These compounds are preferably used below their cloud point temperature. In this event, they do not form an emulsion. They may be utilized in a concentration that may in any event be greater than 5 mg/l. Through the addition of the polyethers with strongly hydrophobic side chains it is possible to operate the electrolyte plainly with partial current filtration, without using active carbon. It has been recognized that perfluorated alkyl chains or organic silicone chains, respectively siloxane chains in particular, exhibit this outstanding effect. Ordinary long-chained alkyl ethoxylates or alkyl propoxylates do not exhibit this effect.

Accordingly, the advantages of the presence of polyethers with strongly hydrophobic side chains in the electrolyte intended to produce satin nickel deposits are:

1. Preparing a stable dispersion even in electrolytes containing up to 100 g/l of nickel ions. A nickel ion content of 70 g/liter will generally be sufficient.

2. The dispersion can be removed from the electrolyte through simple filtration. The electrolyte can be operated plainly with partial current filtration, without using active carbon.

3. Thanks to the improved efficiency of the polyethers with strongly hydrophobic side chains, a film that may be wiped away ("silver layer") is prevented from forming after chromium plating.

4. There are no interferences with usual wetting agents of the classes alkyl sulfates, alkyl ether sulfates or alkylaryl sulfonates which are being utilized to prevent the formation of pits in baths for producing bright or semi-bright deposits.

5. In adding the polyethers with strongly hydrophobic side chains, the satin effect is increased, which is particularly appreciated by users looking for a plain satin effect. With the known nickel electrolytes, a satin effect can only be achieved by adding large quantities of quaternary ammonium compounds. This in turn reduces the life of the electrolyte for producing satin nickel deposits.

The at least one polyether with strongly hydrophobic side chains preferably has the following general chemical formula (I):

(I)

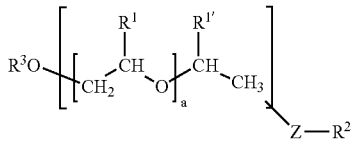

wherein $R^1$ and $R^{1'}$ are independently hydrogen or methyl and can be selected independently in each $[(CH_2CHR^1O)]_a$—$CHR^{1'}$—$CH_3$ unit of the polyether, $R^3$ is hydrogen or a linear chain or branched chain $C_1$- to $C_{18}$-alkyl, a is an integer from 0 to 500, Z is a grouping selected from the group comprising a single bond, $CH_2$, O, $NR^4$, $SO_2$, S, $NR^4SO_2$, COO, CO and $NR^4CO$, wherein $R^4$ is hydrogen or a linear chain or branched chain $C_1$- to $C_{18}$-alkyl group, $R^2$ is a moiety selected from the group comprising (II)

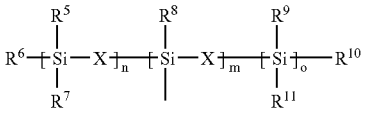

(III)

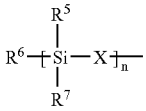

(IV)

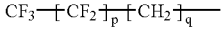

wherein the chains of the groups having the formulae (II), (III) and (IV) can be either linear or branched;

X is a single bond or O;

n and m are integers from 0 to 12, wherein n+m is at least 1;

o is either 0 or 1;

p is an integer from 2 to 12;

q is an integer from 0 to 6;

$R^5$, $R^6$, $R^7$, $R^8$, $R^9$, $R^{10}$ and $R^{11}$ are selected independently and are each a moiety selected from the group comprising hydrogen, a linear chain or branched chain $C_1$- to $C_{18}$-alkyl and substituted or unsubstituted phenyl; and instead of a hydrogen atom the hydrophobic side chain —Z—$R^2$ is bound to a carbon atom of the unit ($CH_2CHR^1O$) in the polyether or to a carbon atom of the end group —$CHR^{1'}CH_3$ in the polyether.

For a, the unit $[(CH_2CHR^1O)]_a$ has a range preferably greater than zero. a more preferably has a range of at least 1, and more specifically ranges from 1 to 500.

The units ($CH_2$—$CHR^1$—O) in the general formula (I) can be selected independently in any unit within the molecule so that these polyalkylene glycol groups can be present in the form of a block polymer or of a copolymer. If the polyalkylene glycol group is present in the form of a block polymer, a polypropylene unit can be arranged between a polyethylene unit and the $R^3O$-group or a polyethylene unit between a polypropylene unit and the $R^3O$-group.

Several hydrophobic side chains —Z—$R^2$ can be bound to the polyalkylene glycol group. The hydrophobic side chains —Z—$R^2$ can thereby be bound to any carbon atoms of the polyalkylene glycol group with a respective one of the hydrogen atoms in the general formula (I) being replaced by a hydrophobic side chain —Z—$R^2$. Preferably, one hydrophobic side chain at most is bound to each unit ($CH_2$—$CHR^1$—O) of the polyalkylene glycol group. According to a particular embodiment, it is altogether also possible to have but one hydrophobic side chain bound to the polyalkylene glycol group. Further instead of a hydrogen atom the hydrophobic side chain —Z—$R^2$ can also be bound to a carbon atom of the end group $CHR^{1'}$—$CH_3$ of the polyether grouping.

$R^3$, $R^4$, $R^5$, $R^6$, $R^7$, $R^8$, $R^9$, $R^{10}$ and $R^{11}$ preferably are hydrogen or a linear or branched $C_1$- to $C_4$-alkyl and most preferably methyl.

In a preferred embodiment of the invention Z is O, if $R^2$ is given by one of the general formulae (III) and (IV) and if X is a single bond in the case of the general formula (III).

In another preferred embodiment Z is $CH_2$ if $R^2$ is given by the general formula (II).

The polyethers with strongly hydrophobic side chains listed in Table 1 have proved particularly efficient.

The concentration of the polyethers with the strongly hydrophobic side chains in the nickel electrolyte is very low and can range from 0.005 to 5 g/l, preferably from 0.005 to 0.5 g/l, more specifically be of 0.1 g/l. More specifically preferred is a concentration of the polyethers with strong hydrophobic side chains in the range of from 20 to 100 mg/l and most preferred a concentration of 50 mg/l if a long lasting effect is wanted. It has to be taken into consideration that commercialized products are hardly ever 100 percent pure but generally contain water and sometimes even low alcohols acting as a solubilizer. The concentration values given herein above are related to a 100 percent pure product.

The electrolyte for the deposition of nickel deposits with the added polyether having strongly hydrophobic side chains generally consists of a nickel salt solution that may additionally contain a weak acid as a buffering agent.

In practice, a Watts bath is used, which has the following composition:

| | |
|---|---|
| 280-550 g/l | nickel sulfate ($NiSO_4 \cdot 7\ H_2O$) |
| 30-150 g/l | nickel chloride ($NiCl_2 \cdot 6\ H_2O$) |
| 30-50 g/l | boric acid ($H_3BO_3$) |

The pH of the bath can range from 3 to 5.5, preferably from 3.8 to 4.4. To increase the cathodic current density, the temperature may range up to 75° C. It preferably ranges from 50° C. to 60° C.

The electrolytes intended to produce satin nickel deposits contain from 10-50 g/l chloride and yield the best results using the polyethers with strongly hydrophobic side chains. Nickel chloride can also be replaced in part or in whole with sodium chloride. The chloride in the electrolyte can be replaced in part or in whole with stoichiometrically equivalent amounts of bromide. In part, the nickel salts can also be replaced with cobalt salts. When using the high performance electrolytes indicated and adjusting the temperature to 55° C., the current density amounts to up to 10 A/dm$^2$. Usually, the current density ranges from 3 to 6 A/dm$^2$. The exposure time in the electrolyte for producing satin nickel deposits preferably amounts to 1 to 20 minutes, most preferred is a time of 6 to 12 minutes.

The polyethers with strongly hydrophobic side chains can be added alone to the electrolyte. However, optimum results are only obtained by concurrently using primary brighteners. In additionally using these, an excellent deposit with satin gloss finish can be achieved over the entire current density range needed for practical operation, said deposit with satin gloss finish appearing to be optically uniform during an operation of the electrolyte of at least 15 hours and lacking any haze that can be wiped away if chromium plating is conducted for a long time.

By primary brighteners unsaturated, mostly aromatic sulfonic acids, sulfonamides or sulfimides or the salts thereof are meant. The best known compounds are for example m-benzene disulfonic acid or benzoic acid sulfimide (saccharine) as well as the salts thereof. Known primary brighteners, which in most cases are used in the form of the sodium or potassium salts thereof, are indicated in Table 2. It is also possible to use several primary brighteners simultaneously.

The primary brighteners according to Table 2 are added to the electrolyte in an amount of about 5 mg/l, more specifically of 50 mg/l, up to 10 g/l, preferably of from 0.5 to 2 g/l. If these compounds alone are added to the electroplating bath they produce a bright deposit in a certain current density range. Therefore, the exclusive use thereof has no practical significance. The desired satin effect is only obtained by further adding, in addition to said compounds, quaternary ammonium compounds.

The quaternary ammonium compounds are cationic active wetting agents having the general formula (V)

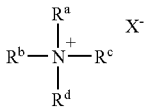

(V)

wherein $R^a$, $R^b$, $R^c$ and $R^d$ may be the same or different and be a linear or branched, possibly unsaturated $C_1$- to $C_{18}$-alkyl chain; mixtures of natural components such as tall, cocos, myristyl and lauryl groups may be utilized, and $R^b$ and $R^c$ may be hydrogen;

$R^d$ most preferably is a $C_1$- to $C_4$-alkyl group or possibly an alkyl substituted aromatic group such as for example a benzyl group;

$X^-$ preferably is an anion, e.g., chloride, bromide, formate or sulfate.

Examples of these quaternary compounds are listed in Table 3.

The quaternary ammonium compounds are used in a concentration of about 0.1 mg/l, more specifically of about 5 mg/l, up to 100 mg/l. Current wetting agents used to prevent the formation of pits in the deposit need not be added to the electrolyte intended to produce a satin nickel deposit; most of these compounds disturb the deposition of nickel.

The work piece to be electroplated is slowly moved during deposition. Additional air injection is seldom used. Circulation pumps and possibly an overflow are often needed. They promote uniform deposition of satin nickel layers. During the deposition process, the plating bath is preferably continuously or discontinuously pumped and/or filtered.

A combination of the polyethers having strongly hydrophobic side chains with quaternary ammonium compounds having at least one ester of sulfosuccinic acid also yields aesthetic satin type nickel deposits. These electrolytes are stable for a long time. In the present case, the esters of sulfosuccinic acid of preference have the general formula (VI):

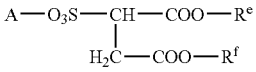

(VI)

wherein $R^e$ and $R^f$ may be the same or different and may be a linear or branched or cyclic $C_1$- to $C_{18}$-alkyl chain, which is possibly unsaturated or interrupted by ether groups, wherein one of the two groups $R^e$ and $R^f$ also may be a hydrogen ion (acid group) or an alkali ion, an ammonium ion or an alkaline earth ion;

A may be a hydrogen ion (acid group) or an alkali ion, an ammonium ion or an alkaline earth ion.

The esters of sulfosuccinic acids listed in Table 4 have proved efficient.

The following examples will serve to explain the invention in closer detail:

EXAMPLE 1.0

At first 0.015 g/l of the quaternary ammonium compound No. 7 (Table 3) was added to an electrolyte having the following composition:

| | |
|---|---|
| 290 g/l | nickel sulfate ($NiSO_4 \cdot 7\ H_2O$) |
| 40 g/l | nickel chloride ($NiCl_2 \cdot 6\ H_2O$) |
| 40 g/l | boric acid ($H_3BO_3$) |
| 3 g/l | primary brightener No. 7 (Table 2) in the form of a sodium salt. |

The electrolyte was tested in a 100 liter tank at 55° C. with the work pieces being moved. A scratched, bent copper sheet of 7 cm×20 cm was electroplated for 17 minutes at 2.5 A/dm$^2$. The resulting deposit had an irregular, quite weak satin gloss finish over the entire sheet as the nickel content was too low.

EXAMPLE 1.1

0.015 g/l of the polyether compound No. 2 (Table 1) was additionally added to the electrolyte of Example 1.0 (with the same nickel content).

The test was performed as described in Example 1.0. The deposit obtained had a uniform, intense satin gloss finish over the entire sheet.

Result of the Examples 1.0 and 1.1: without the polyethers having a hydrophobic side chain being used and with the nickel content chosen, the deposit obtained had a quite weak, irregular satin gloss finish, whereas, with the polyethers with hydrophobic side chain being used, the deposit obtained had an intense, uniform satin gloss finish with an outstanding optical appearance.

EXAMPLE 2.0

At first 0.015 g/l of the quaternary ammonium compound No. 6 (Table 3) was added to an electrolyte having the following composition:

| | |
|---|---|
| 430 g/l | nickel sulfate ($NiSO_4 \cdot 7\ H_2O$) |
| 40 g/l | nickel chloride ($NiCl_2 \cdot 6\ H_2O$) |
| 40 g/l | boric acid ($H_3BO_3$) |
| 3 g/l | primary brightener No. 7 (Table 2) in the form of a sodium salt. |

The electrolyte was tested in a 10 liter tank at 55° C. with the work pieces being moved. A scratched, bent copper sheet of 7 cm×10 cm was electroplated for 15 minutes at 2.5

A/dm$^2$. The resulting deposit had a slightly irregular, weak satin gloss finish over the entire sheet. Neither defects nor black pits could be detected. Every hour a sheet was tested and then compared with those tested previously. After four hours, the sheets already showed a coarser, unsightly deposit. After five hours, the test had to be discontinued as the quality was too bad (irregular to matte).

EXAMPLE 2.1

At first 0.015 g/l of the quaternary ammonium compound No. 6 (Table 3) and in addition thereto 0.02 g/l of the polyether compound No. 5 (Table 1) were added to the electrolyte of Example 1.0.

The test was performed as described in Example 1.0. The deposit obtained had a uniform, strong satin gloss finish over the entire sheet. Neither defects nor black pits could be detected. Every hour a sheet was tested and then compared with those tested previously. After 15 hours the test was discontinued as the deposits still continued to show the same good quality.

Result of the Examples 2.0 and 2.1: without the polyether compound, the life time of the electrolyte was of 4-5 hours only. By additionally using the polyether compounds, the life time of the electrolyte could be prolonged to more than 15 hours. On the other hand, with the polyether compounds being used, the appearance was much more attractive. The deposit obtained had a very uniform, strong satin gloss finish over the entire sheet.

It is to be understood that various modifications and substitutions by technically means may be applied to what has been described by way of the examples and of the drawings hereinabove, without departing from the scope of the invention as defined by the appended claims.

TABLE 1

Polyethers with strongly hydrophobic side chains

| No. | | operating concentration [mg/l |
|---|---|---|
| 1 | polyethylene glycol octa dimethyl siloxane ether | 5-500 |
| 2 | polyethylene glycol-polypropylene glycol-hexa dimethyl siloxane ether (copolymer or block polymer) | 2-400 |
| 3 | polyalkylene glycol tetra silane ether (copolymer or block polymer) | 2-400 |
| 4 | polypropylene glycol octa dimethyl silane ether | 5-600 |
| 5 | perfluoroctyl sulfonamidopolyethoxylate | 5-500 |
| 6 | perfluorhexyl sulfonamidopolypropoxylate | 1-300 |
| 7 | perfluorbutyl sulfonamidopolyalkoxylate (copolymer or block polymer with ethylene and propylene oxide) | 5-1000 |
| 8 | polyethylene glycol perfluoroctane acid ester | 5-500 |
| 9 | polypropylene glycol perfluor hexyl ether | 5-600 |
| 10 | perfluoroctyl sulfone-(N-ethyl)-amidopolyethoxylate | 4-400 |
| 11 | methyl polyalkylene glycol polymethyl siloxane ether | 5-500 |
| 12 | polyethylene glycol-ω-tridecafluoroctane ether | 10-800 |

TABLE 2

Primary brighteners

| No. | |
|---|---|
| 1 | m-benzene disulfonic acid |
| 2 | vinyl sulfonic acid |

TABLE 2-continued

Primary brighteners

| No. | |
|---|---|
| 3 | allyl sulfonic acid |
| 4 | propyne sulfonic acid |
| 5 | p-toluene sulfonic acid |
| 6 | p-toluene sulfonamide |
| 7 | benzoic acid sulfimide |
| 8 | 1,3,6-naphthalene trisulfonic acid |
| 9 | benzoyl benzene sulfonamide |

TABLE 3

Quaternary ammonium compounds

| No. | |
|---|---|
| 1 | dioctyl dimethyl ammonium chloride |
| 2 | didecyl dimethyl ammonium chloride |
| 3 | didodecyl dimethyl ammonium bromide |
| 4 | dodecyl dimethyl benzyl ammonium chloride |
| 5 | tetradecyl dimethyl benzyl ammonium chloride |
| 6 | hexadecyl dimethyl benzyl ammonium chloride |
| 7 | cocosyl dimethyl benzyl ammonium chloride |
| 8 | stearyl dimethyl benzyl ammonium chloride |
| 9 | oleyl dimethyl benzyl ammonium chloride |
| 10 | dilauryl dimethyl ammonium bromide |

TABLE 4 sulfosuccinic acid ester

| No. | |
|---|---|
| 1 | sulfosuccinic acid dibutyl ester |
| 2 | sulfosuccinic acid diisobutyl ester and all the homologues of this compound |
| 3 | sulfosuccinic acid dioctyl ester |
| 4 | sulfosuccinic acid-bis-(1,3-dimethyl butyl)-ester |
| 5 | sulfosuccinic acid dihexyl ester |
| 6 | sulfosuccinic acid-bis-(2-ethyl hexyl ester)-ester |
| 7 | sulfosuccinic acid diisooctyl ester and all the homologues of this compound |
| 8 | sulfosuccinic acid diisopropyl ester |
| 9 | sulfosuccinic acid dipentyl ester |
| 10 | sulfosuccinic acid dicyclo hexyl ester |
| 11 | sulfosuccinic acid monododecyl ester |

The invention claimed is:

1. An acid plating bath for the electrolytic deposition of satin nickel deposits containing a nickel electrolyte, at least one quaternary ammonium compound and at least one polyether, the at least one polyether having at least one strongly hydrophobic side chain, wherein the at least one polyether has the following general chemical formula (I):

(I)

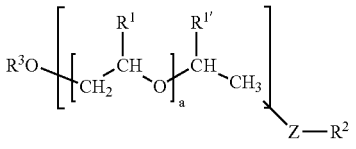

wherein $R^1$ and $R^{1'}$ are independently hydrogen or methyl and can be selected independently in each $[(CH_2CHR^1O)]_a$—$CHR^{1'}$—$CH_3$ unit;

$R^3$ is hydrogen or a linear chain or branched chain $C_1$- to $C_{18}$-alkyl;

a is an integer from 0 to 500;

Z is a grouping selected from the group consisting of a single bond, $CH_2$, O, $NR^4$, $SO_2$, S, $NR^4SO_2$, COO, CO and $NR^4CO$, wherein $R^4$ is hydrogen or a linear chain or branched chain $C_1$- to $C_{-18}$-alkyl group;

$R^2$ is a moiety selected from the group consisting of (II)

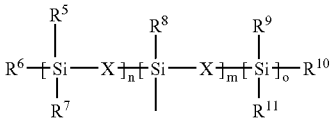

(III)

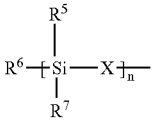

and wherein the chains of the groups having the formulae (II) and (III) can be either linear or branched;

X is a single bond or O:

n and m are integers from 0 to 12, wherein n+m is at least 1;

o is either 0 or 1;

$R^5$, $R^6$, $R^7$, $R^8$, $R^9$, $R^{10}$ and $R^{11}$ are selected independently and are each a moiety selected from the group consisting of hydrogen, a linear chain or branched chain $C_1$- to $C_{18}$-alkyl and substituted or unsubstituted phenyl; and instead of a hydrogen atom the hydrophobic side chain —Z—$R^2$ is bound to a carbon atom of the unit —$CH_2$—$CHR^1$—O— or to a carbon atom of the end group —$CHR^{1'}$—$CH_3$.

2. The acid plating bath according to claim 1, wherein Z is O if $R^2$ is given by the general formula (III) and if X is a single bond.

3. The acid plating bath according to claim 1, wherein Z is $CH_2$ if $R^2$ is given by the general formula (II).

4. The acid plating bath according to any one of claims 1 to 3, wherein the group —Z—$R^2$ is bound to a carbon atom of the end group $CH_3$ of the at least one polyether instead of to a hydrogen atom.

5. The acid plating bath according to any one of the preceding claims 1-3, wherein the at least one polyether is selected from the compounds consisting of polyethylene glycol octa dimethyl siloxane ether, polyethylene glycol-polypropylene glycol-hexa dimethyl siloxane ether copolymer, polyethylene glycol-polypropylene glycol-hexa dimethyl siloxane ether block polymer, polyalkylene glycol tetra silane ether copolymer, polyalkylene glycol tetra silane ether block polymer, polypropylene glycol octa dimethyl silane ether, and methyl polyalkylene glycol polymethyl siloxane ether.

6. The acid plating bath according to any one of the preceding claims 1-3, wherein the concentration of the at least one polyether ranges from 0.005 to 0.5 g/l.

7. The acid plating bath according to any one of the preceding claims 1-3, wherein at least one primary brightener is additionally included.

8. The acid plating bath according to claim 7, wherein the concentration of the at least one primary brightener ranges from 0.005 to 10 g/l.

9. The acid plating bath according to any one of the preceding claims 1-3, wherein the concentration of the at least one quaternary ammonium compound ranges from 0.000 1 to 0.1 g/l.

10. The acid plating bath according to any one of the preceding claims 1-3, wherein at least one sulfosuccinic acid ester is additionally included.

11. The acid plating bath according to any one of the preceding claims 1-3, wherein at least one cobalt ion source is additionally included.

12. The acid plating bath according to claim 1, wherein the acid plating bath is an electroplating bath.

13. A method for the electrolytic deposition of a satin nickel deposit onto a substrate, comprising the method steps:

a) contacting the substrate with the acid plating bath according to any one of claims 1, 2, 3, and 12; and b) setting a current flow between the substrate and an anode.

14. The method according to claim 13, wherein the plating bath is pumped and/or filtered continuously or discontinuously.

* * * * *